US006216318B1

(12) United States Patent
Leifeld

(10) Patent No.: US 6,216,318 B1
(45) Date of Patent: Apr. 17, 2001

(54) FEED TRAY ASSEMBLY FOR ADVANCING FIBER MATERIAL IN A FIBER PROCESSING MACHINE

(75) Inventor: Ferdinand Leifeld, Kempen (DE)

(73) Assignee: Trützschler GmbH & Co. KG, Mönchengladbach (DE)

( * ) Notice: Subject to any disclaimer, the term of this patent is extended or adjusted under 35 U.S.C. 154(b) by 0 days.

(21) Appl. No.: 09/388,548

(22) Filed: Sep. 2, 1999

Related U.S. Application Data

(63) Continuation of application No. 09/332,531, filed on Jun. 14, 1999.

(30) Foreign Application Priority Data

Jun. 12, 1998 (DE) ..... 198 26 070

(51) Int. Cl.[7] ..... D01G 15/40
(52) U.S. Cl. ..... 19/105; 19/204
(58) Field of Search ..... 19/98, 105, 200, 19/202, 203, 204, 205

(56) References Cited

U.S. PATENT DOCUMENTS 4,184,611 1/1980 Binder et al. .
4,742,879 5/1988 Leifeld .

FOREIGN PATENT DOCUMENTS 34 13 595 A1 4/1984 (DE) .
33 15 909 A1 11/1984 (DE) .
39 05 139 A1 8/1990 (DE) .
43 34 035 A1 6/1994 (DE) .
0 275 471 7/1988 (EP) .
715413 9/1954 (GB) .
2 274 288 7/1994 (GB) .

*Primary Examiner*—John J. Calvert
*Assistant Examiner*—Gary L. Welch
(74) *Attorney, Agent, or Firm*—Venable; Gabor J. Kelemen

(57) ABSTRACT

A fiber processing machine for forming a fiber lap from fiber tufts, includes a fiber feeding assembly which has a feed roll having a rotary axis; a carrier element extending adjacent and along the feed roll; and a feed tray array cooperating with the feed roll for drawing fiber material into a nip defined between the feed tray array and the feed roll and for discharging the fiber material from the nip. The feed tray array is composed of a series of individual feed trays lined up along the feed roll. Individual, separate rotary supports for mounting each feed tray on the carrier element provide for a pivotal motion of each feed tray in a plane generally perpendicular to the rotary axis of the feed roll.

12 Claims, 6 Drawing Sheets

FEED TRAY ASSEMBLY FOR ADVANCING FIBER MATERIAL IN A FIBER PROCESSING MACHINE

CROSS REFERENCE TO RELATED APPLICATION

This application is a continuation of pending U.S. application Ser. No. 09/332,531 filed Jun. 14, 1999.

This application claims the priority of German Application No. 198 26 070.9 filed Jun. 12, 1998, which is incorporated herein by reference.

BACKGROUND OF THE INVENTION

This invention relates to a feed tray assembly in a fiber processing machine which forms a fiber lap (fiber batt), for example, from wool or chemical fiber tufts. The machine includes a fiber feeding device composed of a slowly rotating feed roll cooperating with a feed tray. A rapidly rotating opening roll is disposed immediately downstream of the feed roll (as viewed in the direction of fiber advance). The fiber feeding device and the opening roll withdraw the fiber material from a reserve chute and forward the material to a downstream-arranged device for processing the fiber material. The feed tray assembly includes a feed tray array formed of a plurality of individual feed trays rotatable about an axis.

In a known device of the above-outlined type as disclosed, for example, in German Offenlegungsschrift (application published without examination) 34 13 595, in a fiber tuft feeder for a card, above the opening roll which separates the upper chute (reserve chute) from the lower chute (feed chute), a feed roll is disposed which draws the fiber tufts from the upper chute in cooperation with a feed tray array which is composed of a plurality of closely side-by-side arranged individual feed trays. Each feed tray is pivotal about an axis which extends parallel to the feed roll axis. The individual feed trays are pivoted by the fiber tufts to an extent which depends from the mass of the fiber tufts passing through the gap defined by the feed trays and the feed roll. The feed trays are situated at the outlet of the upper chute. The support shaft on which all the individual feed trays are mounted extends beyond the two flanking (outermost) feed trays and is disposed in the narrow, air-impervious side walls of the reserve chute.

It is a disadvantage of such a prior art arrangement that the tray-supporting shaft which extends throughout the width of the tuft feeder, sags so that it cannot be used in case of wide roller card feeders which may have a width of over 3 m. It is a further drawback that the distance between the individual feed trays, on the one hand and the feed roll, on the other hand, is altered in an undesired manner. Further, the pressing forces urging the feed trays against the feed roll are not uniform which may lead to changes or misalignments of the clearance between adjoining feed trays, likely to cause operational disturbances. It is a further disadvantage of the prior art arrangements that the feeding device cannot be adapted to different types of fiber material, particularly different fiber lengths.

SUMMARY OF THE INVENTION

It is an object of the invention to provide a fiber feeding assembly of the above-outlined type from which the discussed disadvantages are eliminated and which, in particular, is operationally reliable and makes possible an exact clamping of the fiber material between the individual feed trays and the feed roll.

This object and others to become apparent as the specification progresses, are accomplished by the invention, according to which, briefly stated, the fiber processing machine for forming a fiber lap from fiber tufts includes a fiber feeding assembly which has a feed roll having a rotary axis; a carrier element extending adjacent and along the feed roll; and a feed tray array cooperating with the feed roll for drawing fiber material into a nip defined between the feed tray array and the feed roll and for discharging the fiber material from the nip. The feed tray array is composed of a series of individual feed trays lined up along the feed roll. Individual, separate rotary supports for mounting each feed tray on the carrier element provide for a pivotal motion of each feed tray in a plane generally perpendicular to the rotary axis of the feed roll.

By providing that each individual feed tray has its own rotary support and that all rotary supports are mounted on a common stable support element, a linear alignment of the rotary axes of the individual feed trays is ensured in a simple manner. Between the individual feed trays and the feed roll in all zones the same pressing forces prevail, as related to the axial length units of the feed roll. At the same time, undesired deformations relative to the rotary axes and as concerns the distance between the individual feed trays are avoided whereby the operational reliability and uniformity of the fiber material are improved.

The invention has the following additional advantageous features:

- The individual feed trays and the feed roll are supported independently from one another, and the location of the support for the feed trays and/or the support for the feed roll may be changed relative to one another.
- The carrier element is an elongated member such as a carrier beam which is hollow, which resists bending and whose opposite ends are supported on the side walls of the machine frame.
- The carrier element is hollow and has a square or rectangular cross section, it is made of steel and has moments of inertia which are at least approximately identical in a vertical direction, and do not vary to a greater extent than a ratio of 1:1.5.
- The moments of resistance of the carrier element are similar to one another.
- Each individual feed tray is biased by a spring or a pneumatic element and all biasing elements are counter supported by the carrier element.
- With the carrier element and the individual feed trays respective springs are associated which are supported at one end by the carrier element and, at the opposite end, by the respective individual feed tray.
- Each individual feed tray is rotatably supported at one end thereof.
- The rotary supports for the individual feed trays are secured to the carrier element or are arranged adjacent thereto.
- For each feed tray spring a holding element (such as an angled member) is provided and each individual feed tray is mounted on an individual holding element.
- The springs and the rotary supports of the individual feed trays are positioned close to the corners of the carrier element.
- The pressing forces between the individual feed trays on the one hand and the feed roll on the other hand are at least approximately identical.
- At least one abutment is provided for limiting the rotary motion of the individual feed trays and the abutment is fixed relative to the carrier element.

The feed trays are extruded members made, for example, of aluminum or an aluminum alloy.

The surface of each individual feed tray oriented towards the fiber material is wear resistant and is, for example, a sheet metal of high grade steel or the feed tray surface is plated.

The sheet metal is bonded to the feed tray surface by gluing.

The opening roll is a preliminary roll of a roller card unit.

An additional preliminary roll is associated with the preliminary roll of the roller card unit.

The support element is situated externally of the feed chute.

DESCRIPTION OF THE PREFERRED EMBODIMENTS

Figure 1:
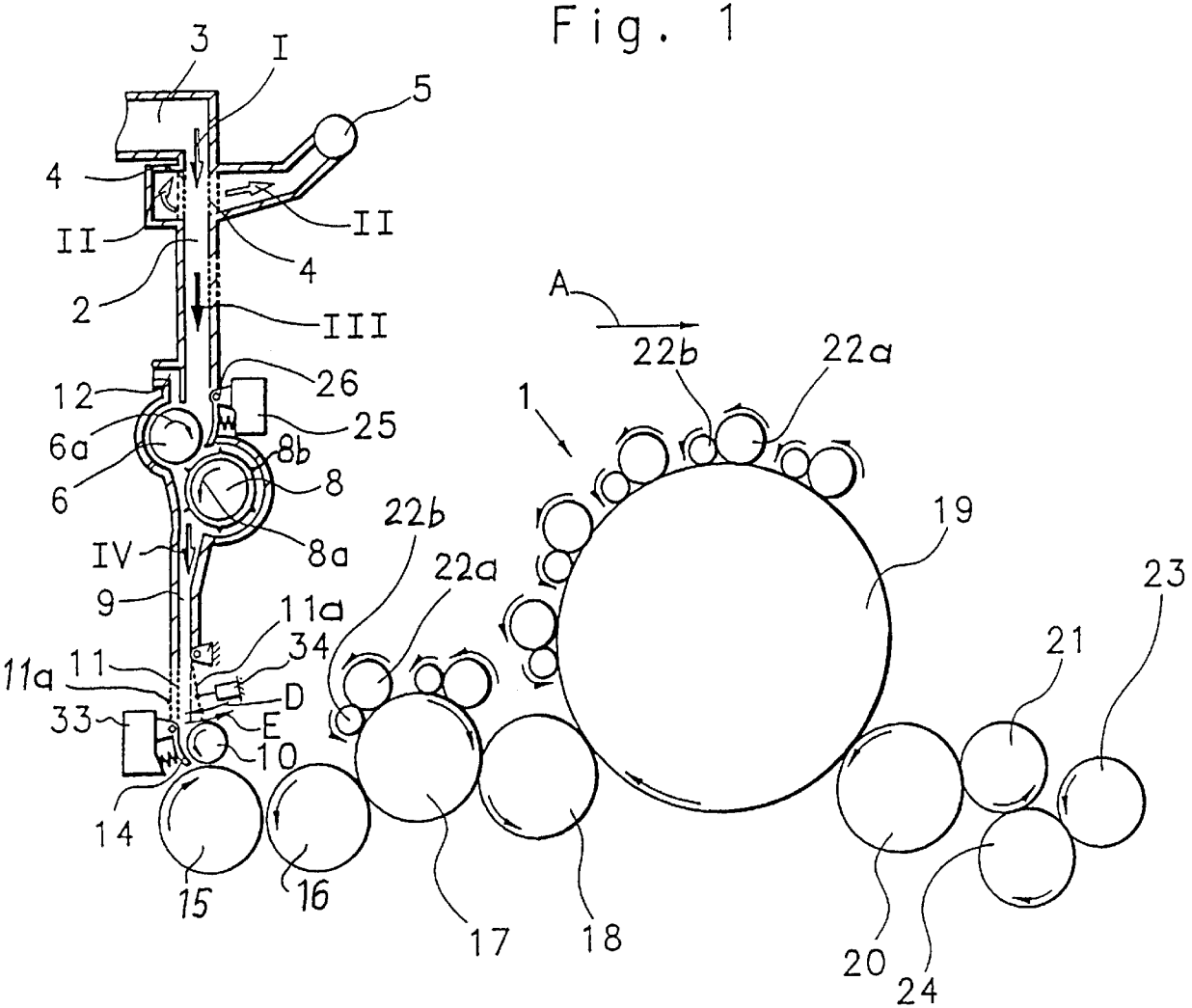
FIG. 1 is a schematic side elevational view of a machine assembly formed of a roller card and a roller card feeder incorporating the invention.

Turning to FIG. 1, upstream of a roller card unit 1 a fiber feeder is located, having a vertically oriented reserve chute 2 charged from above with a mixture I of air and finely opened fiber material (fiber tufts). Such charging may be effected, for example, by a condenser or by a supply and distributor duct 3. In the upper region of the reserve chute 2 air outlet openings 4 are provided through which the transporting air II leaves the reserve chute after being separated from the fiber tufts III by means of a suction device 5. The lower end of the reserve chute 2 is closed off by a feed roll 6 which has a rotary axis 6', a direction of rotation 6*a* and which cooperates with a feed tray array 7 formed of a plurality of individual feed trays 7*a* as shown in FIG. 4*b*. The fiber material III is advanced from the reserve chute 2 by means of the slowly rotating feed roll 6 to a rapidly rotating opening roll 8 having pins 8*b* or a sawtooth clothing on its circumferential surface. One part of the circumference of the opening roll 8 faces a lower feed chute 9. The opening roll 8 which rotates in the direction of the arrow 8*a* advances the fiber material III into the lower chute (feed chute) 9. The feed chute 9 has at its lower end a withdrawing roll 10 which advances the fiber material to the roller card unit 1. The fiber feeder may be an EXACTAFEED model, manufactured by Trutzschler GmbH & Co. KG, Monchengladbach, Germany.

Figure 3:
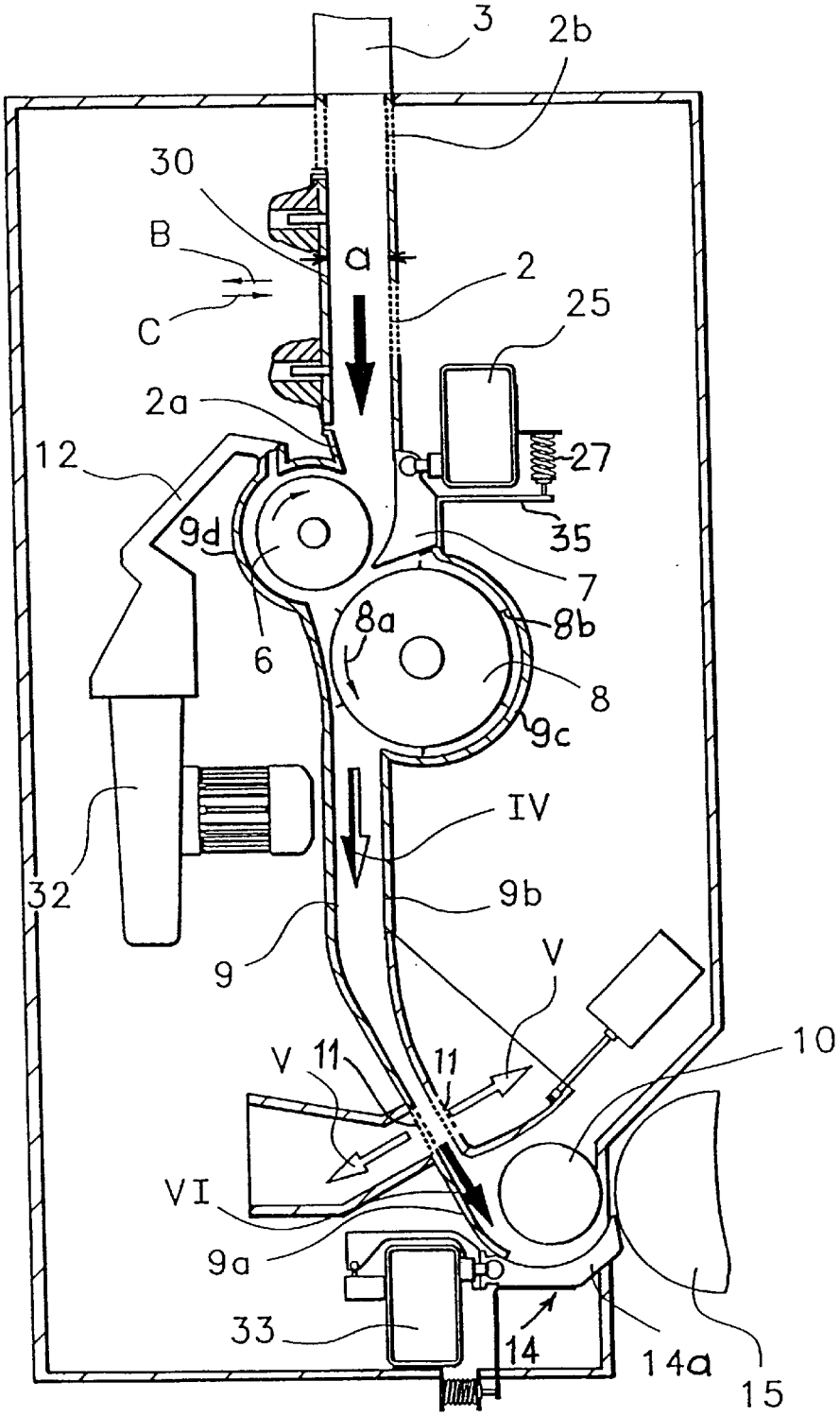
FIG. 3 is a sectional side elevational view of the roller card feeder of FIG. 1, shown on an enlarged scale and illustrating additional details.

Also referring to FIG. 3, the lower part of the walls of the feed chute 9 are provided with air outlet openings 11 to separate the air stream V from the fiber stream VI. At the top, above the feed roll 6, the feed chute 9 is in communication with a duct 12 coupled to the output of a blower 32. The rotating feed roll 6 and the opening roll 8 continuously advance the mixture IV of air and fiber material at a certain flow rate into the feed chute 9 and an identical quantity of fiber VI is drawn from the feed chute 9 by the withdrawing roll 10 which cooperates with a feed tray array 14 composed of a plurality of individual feed trays 14*a* (only one is visible) and which advances the fiber material from the feed chute 9 to the roller card unit 1. The blower 32 drives an air stream from the duct 12 onto the fiber material in the feed chute 9 for ensuring a uniform densification of the fiber material and for maintaining constant the flow rate thereof. The opening roll 8 and the feed roll 6 are surrounded by respective parts 9*c* and 9*d* of the chute 9. The chute parts 9*c* and 9*d* conform to the circumference of the rolls 6 and 8. As viewed in the direction of rotation 8*a* of the opening roll 8, the chute part 9*c* is interrupted by a separating opening for the fiber material. The separating opening is adjoined by the wall region which extends to the feed roll 6.

Figure 2:
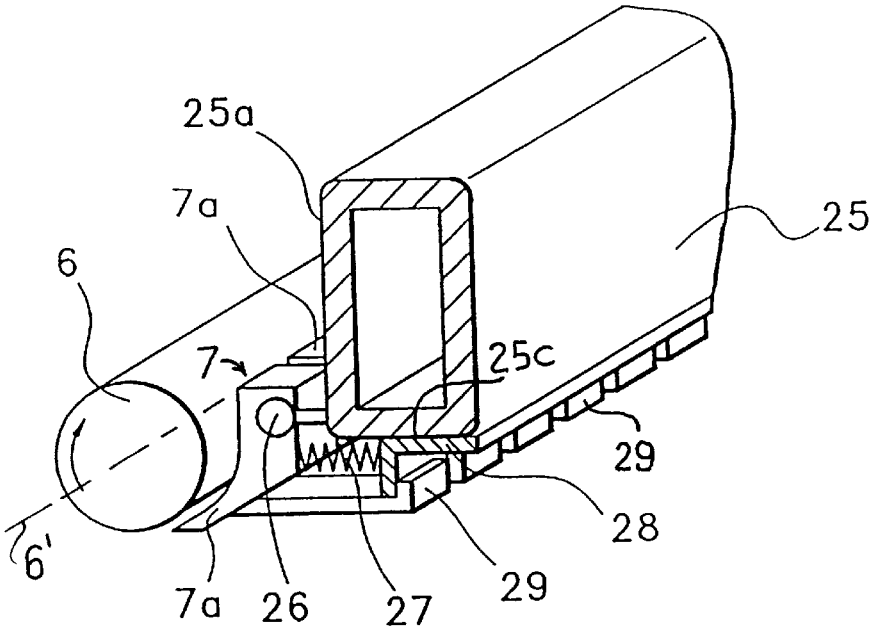
FIG. 2 is a fragmentary perspective view of a feed roll as well as individual feed trays mounted on a carrier element according to the invention.

Also referring to FIG. 2, at the lower end of the wall zone facing the feed roll 6 a feed tray (intake tray) array 7 is arranged. The edge of the feed (intake) tray array 7 is oriented in the rotary direction 8*a* of the opening roll 8. The plane which contains the rotary axes of the feed roll 6 and the opening roll 8 is oriented at an oblique angle to the vertical plane which contains the rotary axis of the opening roll 8. As viewed above the axis of the opening roll 8, the oblique plane is offset relative to the vertical plane in the direction of rotation 8*a* of the opening roll 8. The reserve chute (upper chute) 2 includes wall elements 30*a* which are displaceable in the direction of the chute depth as illustrated in FIG. 4*c*. The wall portions ll*a* of the feed chute 9 which contain the air outlet openings 11 are formed in sections and are supported on the side wall 9*b* for rotation in the direction of the arrows D and E. Each section ll*a* is associated with a setting device 34, such as a pneumatic cylinder. This arrangement allows a sectionwise adjustment of the depth of the feed chute 9 in the region where the fiber lap (fiber batt) is formed.

The feeding device for the roller card unit 1 is constituted by the withdrawing roll 10 and the feed tray array 14 at the lower end of the feed chute 9. Downstream of the feed roll 10 and the feed tray array 14, as viewed in the direction of fiber advance A in the roller card unit 1, there are provided a first preliminary roll 15, a second preliminary roll 16, a licker-in 17, a transfer roll 18, a main cylinder 19, a doffer 20 and a stripping roll 21. With the licker-in 17 and the main cylinder 19 two and, respectively, six roll pairs are associated, each formed of a working roll 22*a* and a reversing roll 22*b*. Two calender rolls 23 and 24 are disposed immediately downstream of the stripping roll 21 to cooperate therewith. The rotation of the individual rolls is indicated by the curved arrows drawn therein.

As shown in FIG. 2, a carrier beam (carrier element) 25 is provided which is made, for example, of structural steel and which has a hollow, rectangular cross-sectional configuration. The carrier beam 25 is stable and resists bending. It has a length of, for example, 5 m or more and extends parallel to and throughout the width of the machine. A plurality of individual feed trays 7*a* are secured by means of respective rotary supports 26 to a side wall 25*a* of the carrier beam 25 between the carrier beam 25 and the feed roll 6. Each feed tray 7*a* is supported by a respective compression spring 27 on a throughgoing angle member 28 which is secured to the bottom wall 25*c* of the carrier beam 25. Further, abutment elements 29 are provided which limit the excursion of the respective feed trays 7*a*.

Turning to FIGS. 3 and 4*c*, the side wall 2*a* of the upper reserve chute 2 has a plurality of wall elements 30 which are displaceable in the direction of the arrows B, C whereby the depth a of the reserve chute 2 may be zonewise adjusted. Each wall element 30 is movable by its own setting device, such as a pneumatic power cylinder 31 coupled to an electronic control and regulating device (such as a microcomputer) 38. The height of the wall elements 30*a* essentially corresponds to the region where the fiber lap is formed from the fiber tufts. As shown in FIGS. 1 and 3, the carrier beam 25, together with the rotatable feed trays 7*a*, is arranged at the lower end of the wall 2*b* of the reserve chute (upper chute) 2. At the lower end of the wall 9*a* of the feed chute 9 a further carrier beam 33 is arranged which, similarly to the carrier beam 25, may be made of structural steel. The carrier beam 33 rotatably supports feed trays 14*a* which form a feed tray array 14. A fan 32 introduces air into the region of the feed roll 6 through the duct 12.

FIG. 4*b* shows that the carrier beam 25 which has a length of approximately 5 m, is disposed in the region of the lower end of the chute side wall 2*b* and extends throughout the width b of the machine and is held in side plates 39*a*, 39*b* of the machine frame by supporting components 25' mounted on the side plates 39*a*, 39*b* and being adjustable relative thereto. The carrier beam 25 rotatably supports five individual feed trays 7*a* each being 1 m wide and made of an extruded aluminum member having a wear-resistant surface exposed to the fibers. The feed trays 7*a* are rotatable in the direction of the arrows F, G by virtue of the rotary supports 26 affixed to the side wall 25*a* of the carrier beam 25.

Figure 4A:
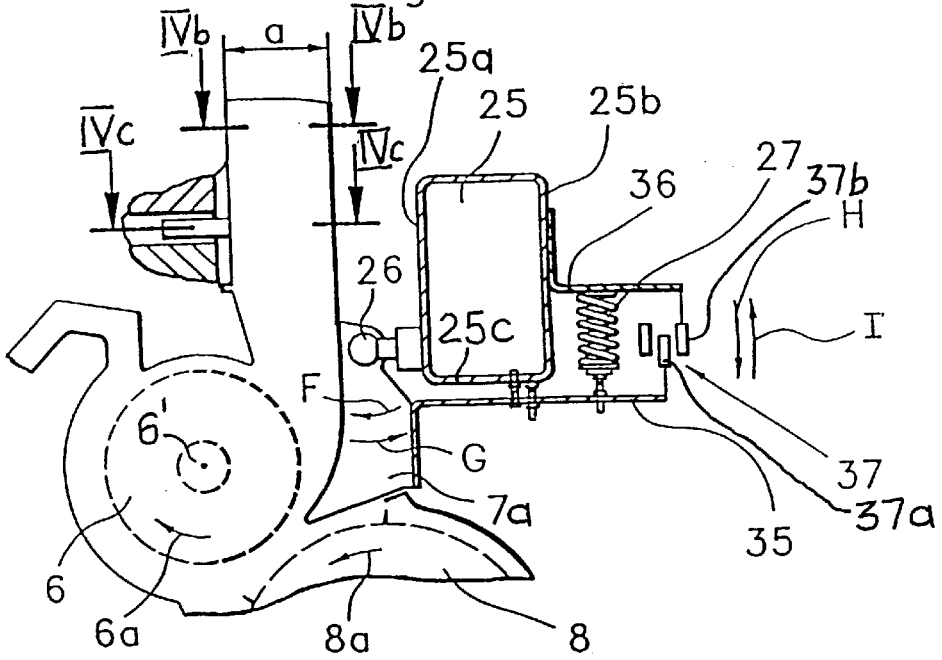
FIG. 4*a* is a sectional side elevational view of the upper part of the construction shown in FIG. 2, wherein the fiber feeding assembly according to the invention is located at the upper feed chute.
Figure 4B:
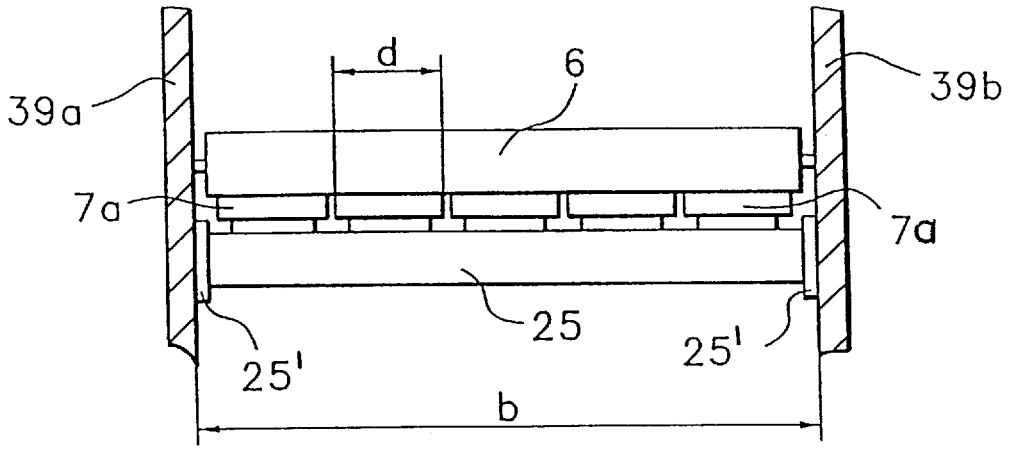
FIG. 4*b* is a sectional view taken along line IVb—IVb of FIG. 4*a*.
Figure 4C:
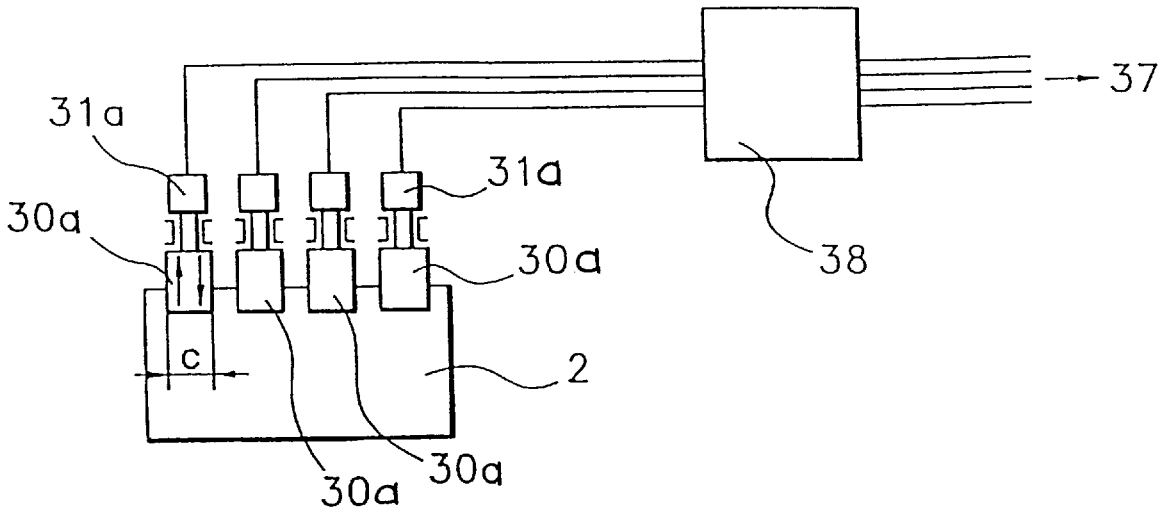
FIG. 4*c* is a sectional view taken along line IVc—IVc of FIG. 4*a*.

As shown in FIG. 4*a*, to the rearward face of each feed tray 7*a* a respective angle member 35 is affixed which is supported on a respective angle member 36 (affixed to the face 25*b* of the carrier beam 25) by a respective compression spring 27. Thus, by virtue of this arrangement each feed tray 7*a* of the feed tray array 7 is urged toward the feed roll 6 by its spring 27 in the direction of the arrow F and each feed tray 7*a* may pivot individually against the force of the spring 27 in the direction of the arrow G as urged by the force exerted on the feed tray 7*a* by the throughgoing fiber material. Between the movable angle member 35 and the fixed angle member 36 an inductive path sensor 37 is arranged. The path sensor 37 has a plunger armature 37*a* cooperating with a plunger coil 37*b* which is coupled to the electronic control and regulating device 38 as shown in FIG. 4*c*. Upon pivotal motion of the feed trays 7*a* and the resulting excursion of the plunger armature 37*a* of the respective inductive path sensor 37 in the direction of the arrows H, I, an electric pulse is generated which represents the excursions which are performed by the feed trays 7*a* in case the fiber thickness varies as the fibers pass through the feed gap defined by the feed roll 6 and the respective feed trays 7*a*. As shown in FIG. 4*b*, the carrier beam 25 with the feed trays 7*a*, on the one hand, and the feed roll 6, on the other hand, are mutually independently secured to the rigid side plates 39*a*, 39*b* of the machine. In this manner the carrier beam 25 with the feed trays 7*a* may be displaced locally relative to the feed roll 6 so that in case of different fiber material, or during maintenance work or the like the distance and thus the intake gap defined between the feed trays 7*a* and the feed roll 6 may be altered and adapted as required.

Figure 5:
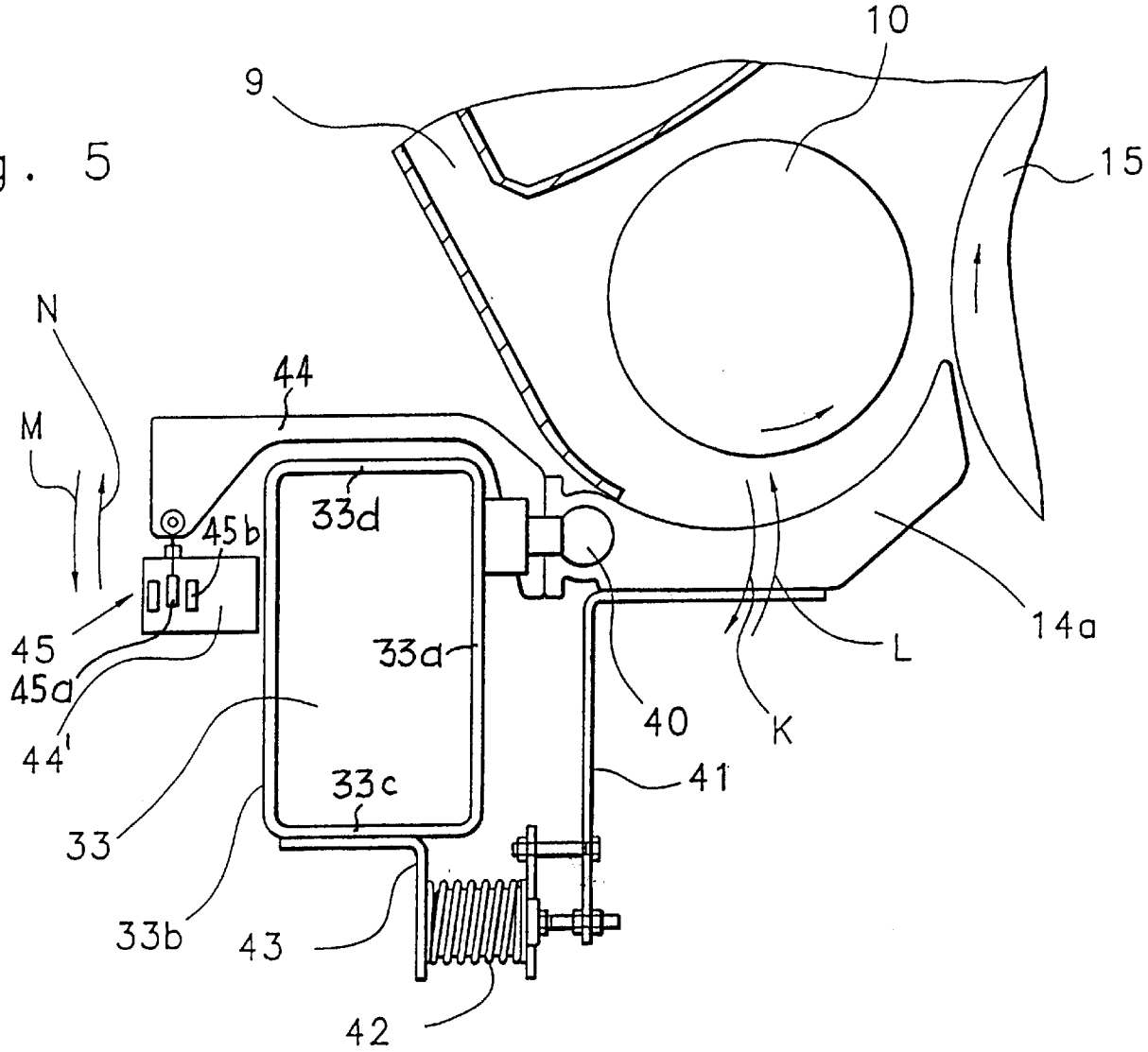
FIG. 5 is a sectional side elevational view of the lower part of the construction shown in FIG. 2, wherein the device according to the invention is located at the lower feed chute.

As shown in FIG. 5, in the region of the lower end of the side wall 9*a* of the feed chute 9 an approximately 5 m long carrier beam 33 is provided which extends over the entire width of the machine. This embodiment has sixteen individual feed trays 14*a* which form a feed tray array 14 and each has a length of 250 mm. Each feed tray 14*a* is an extruded aluminum component having a wear-resistant surface in the area where it is exposed to the fibers. The wear-resistant surface is provided by coating, by plating with high grade steel, or the like. The feed trays 14*a* are, at one of their ends, secured to the side wall 33*a* of the carrier beam 33 by means of respective rotary supports 40 to be rotatable in the direction of the arrows K, L. On their side oriented away from the fibers, each feed tray 14*a* is secured to one leg of respective angled members 41, whereas the other leg of the angled member 41 supports a respective spring 42 which presses against a respective angled member 43 secured to the bottom wall 33*c* of the carrier beam 33. To each rotary support 40 one end of a respective, generally U-shaped lever 44 is affixed which thus rotates as a unit with its associated rotary support 40 and which extends above the top wall 33*d* of the carrier beam 33. A respective support element 44' is affixed to the side wall 33*b* of the carrier beam 33. For each feed tray 14*a*, between the free end of the respective lever 44 and the support element 44' an inductive path sensor 45 is provided which is formed of a plunger armature 45*a* and a plunger coil 45*b* coupled to the electronic control and regulating device 38. In this manner, upon excursions of the feed trays 14*a* and a corresponding movement of the respective path sensor 45 in the direction of the arrows M, N, electric pulses are generated which represent the excursions of the respective feed trays 14*a* when the thickness of the fiber material passing through the intake gap changes.

Figure 6:
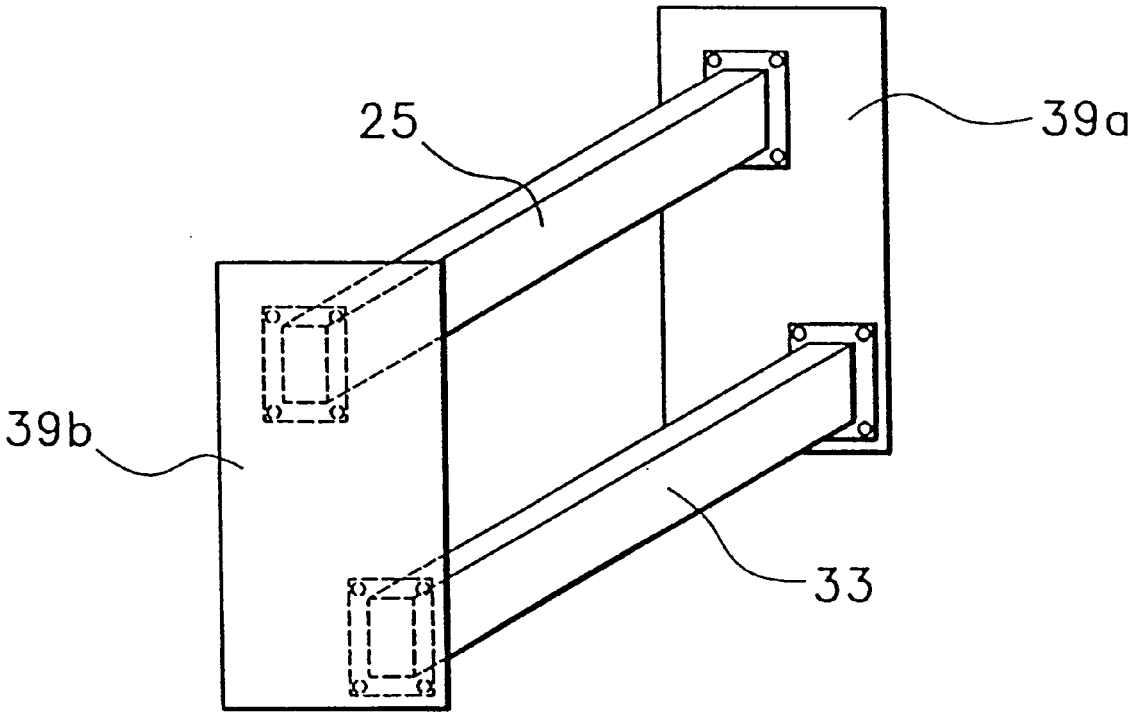
FIG. 6 is a perspective view illustrating the mounting of carrier elements to lateral machine frame walls.

FIG. 6 illustrates the securement of the ends of the carrier beams 25 and 33 to the inner faces of the machine side walls 39*a*, 39*b* by means of screws which may pass through slots of a mounting plate.

The above-described fiber tuft feeder combined with the roller card unit 1 includes the regulating system controlling the fiber lap profile for the roller card unit. Two systems are formed, namely the assembly formed of the feed roll 6 and the feed tray array 7 which close off the upper feed chute 2 and the assembly formed of the withdrawing roll 10 and the feed tray array 14 which closes off the lower end of the feed chute (lower chute) 9. In both systems a series of feed trays (7*a* and 14*a*) are used which cooperate with the feed roll 6 and the withdrawing roll 10, respectively. The feed tray widths and the zone division may be varied and adapted to the requirements.

Between the feed trays 7*a* and the feed roll 6 and the feed trays 14*a* and the withdrawing roll 10 in all zones the same pressing forces relative to the roll length units (for example, 10 cm) are preserved and deformations of a few millimeters are permitted.

All functional elements with the exception of the feed roll 6 and the withdrawing roll 10 are mounted on the carrier beam 25 or 33, while it is ensured that the force paths (represented by the carrier beams 25, 33, the rotary supports 26, 40, the series of feed trays 7*a*, 14*a*, the springs 27, 42) are very short and all elements are situated in the vicinity of the corners of the cross-sectionally rectangular carrier beams 25, 33.

It will be understood that the above description of the present invention is susceptible to various modifications, changes and adaptations, and the same are intended to be comprehended within the meaning and range of equivalents of the appended claims.

What is claimed is:

1. A fiber processing machine for forming a fiber lap from fiber tufts, comprising a fiber feeding assembly including (a) a feed roll having a rotary axis;

(b) a carrier element extending adjacent and along said feed roll;

(b) a feed tray array cooperating with said feed roll for drawing fiber material into a nip defined between said feed tray array and said feed roll and for discharging the fiber material from the nip; said feed tray array being composed of a series of individual feed trays lined up along said feed roll; and (c) a plurality of individual, separate rotary supports secured to said carrier element; said rotary supports pivotally holding respective said feed trays to provide for a pivotal motion thereof in a plane generally perpendicular to said rotary axis of said feed roll.

2. The fiber processing machine as defined in claim 1, further comprising a machine frame; a first support for supporting said carrier element on said machine frame and a second support for supporting said feed roll on said machine frame; said first and second supports being adjustable relative to one another for changing a distance between said carrier element and said feed roll.

3. The fiber feeding assembly as defined in claim 1, wherein said support element is a carrier beam.

4. The fiber processing machine as defined in claim 1, further comprising a machine frame having opposite side walls; further wherein said carrier element has opposite ends supported in said side walls.

5. The fiber processing machine as defined in claim 1, further comprising a machine frame; a support for supporting said carrier element on said machine frame; said support being adjustable relative to said machine frame for changing a position of said carrier element.

6. The fiber processing machine as defined in claim 1, further comprising individual, separate resilient force-exerting components connected to respective said feed trays for urging each said feed tray individually toward said feed roll.

7. The fiber processing machine as defined in claim 1, further comprising individual, separate springs connected to respective said feed trays and supported on said carrier element for urging each said feed tray individually toward said feed roll.

8. The fiber processing machine as defined in claim 1, wherein said rotary supports are mounted directly on said carrier element.

9. The fiber processing machine as defined in claim 1, wherein said carrier element has a rectangular cross section having corner zones; further comprising individual, separate resilient force-exerting components connected to respective said feed trays for urging each said feed tray individually toward said feed roll; said force exerting components and said rotary supports being disposed in said corner zones.

10. The fiber processing machine as defined in claim 1, further comprising at least one an abutment member supported on said carrier element for limiting the pivotal motions of said feed trays.

11. The fiber processing machine as defined in claim 1, further comprising a feed chute through which fiber material passes and in which said feed roll and said feed trays are located; said carrier element being disposed externally of said feed chute.

12. The fiber processing machine as defined in claim 1, further comprising individual, separate sensors coupled to respective said feed trays for applying, to a control and regulating device, electric signals representing excursions of the respective feed trays.

* * * * *